US007712274B2

(12) United States Patent
Wendt et al.

(10) Patent No.: US 7,712,274 B2
(45) Date of Patent: May 11, 2010

(54) DOWNWARDLY ACCESSIBLE LIFT-AND-SHIFT CEILING SYSTEM

(75) Inventors: Alan C. Wendt, Inverness, IL (US); Gerald L. Koski, Parma, OH (US)

(73) Assignee: USG Interiors, Inc., Chicago, IL (US)

( * ) Notice: Subject to any disclaimer, the term of this patent is extended or adjusted under 35 U.S.C. 154(b) by 383 days.

(21) Appl. No.: 11/617,994

(22) Filed: Dec. 29, 2006

(65) Prior Publication Data

US 2008/0155927 A1 Jul. 3, 2008

(51) Int. Cl.
*E04B 9/00* (2006.01)
*E04B 9/28* (2006.01)

(52) U.S. Cl. ..... 52/506.07; 52/506.08; 52/377

(58) Field of Classification Search ..... 52/506.07, 52/506.08, 506.09, 506.1, 364, 377
See application file for complete search history.

(56) References Cited

U.S. PATENT DOCUMENTS 3,023,865 A * 3/1962 Brandstetter ..... 52/506.07
3,207,057 A * 9/1965 Brown et al. ..... 454/301
3,295,284 A * 1/1967 Tschiesche ..... 52/506.07
3,359,696 A 12/1967 Snaith
3,385,021 A 5/1968 Nys
3,475,869 A 11/1969 Jahn
3,640,042 A 2/1972 Kidney
3,832,816 A 9/1974 Jahn
4,027,454 A 6/1977 Schuplin
RE31,528 E 3/1984 Mieyal
4,434,599 A 3/1984 McCall
4,462,198 A * 7/1984 Sharp ..... 52/667
4,505,083 A * 3/1985 Mieyal ..... 52/476
4,542,615 A * 9/1985 McCall ..... 52/506.07
4,586,841 A 5/1986 Hunter (Continued)

FOREIGN PATENT DOCUMENTS

DE 3247506 A1 * 7/1984

(Continued)

OTHER PUBLICATIONS

Notification of Transmittal of International Search Report and the Written Opinion of the International Searching Authority, or the Declaration; International Search Report; Written Opinion of the International Searching Authority for PCT/US07/87093, filed Dec. 12, 2007.

*Primary Examiner*—Brian E Glessner
*Assistant Examiner*—Adriana Figueroa
(74) *Attorney, Agent, or Firm*—Pearne & Gordon LLP

(57) ABSTRACT

A suspended ceiling system comprising grid runners and downwardly accessible generally planar tiles mounted on the grid runners, peripheral tile edges having portions extending horizontally underneath an adjacent grid runner, opposed tile edges having a downwardly facing support surface, said opposed edges having a generally vertical abutment surface above its support surface and resting on an adjacent horizontal flange portion of a grid runner, the runners having locating surfaces of limited height above said flange portions and engageable with the abutment surfaces, the runners and tiles being arranged to permit one of the opposed tile edges to be lifted so that its abutment surface can be raised and thereafter be shifted towards the runner adjacent the lifted edge a distance sufficient to allow the opposite edge to drop below the flange portion of its associated runner.

9 Claims, 2 Drawing Sheets

U.S. PATENT DOCUMENTS

| | | | | | |
|---|---|---|---|---|---|
| 4,677,802 | A | * | 7/1987 | Vukmanic | 52/506.07 |
| 4,679,375 | A | | 7/1987 | Shirey | |
| 4,744,188 | A | | 5/1988 | Ahren | |
| 4,794,745 | A | * | 1/1989 | Platt et al. | 52/506.07 |
| 4,838,002 | A | * | 6/1989 | Dajnko et al. | 52/475.1 |
| 5,077,951 | A | | 1/1992 | Baker | |
| 5,390,456 | A | * | 2/1995 | Platt et al. | 52/311.2 |
| 5,421,132 | A | * | 6/1995 | Bischel et al. | 52/311.3 |
| 5,495,697 | A | | 3/1996 | Bischel et al. | |
| 5,761,869 | A | | 6/1998 | Tinen et al. | |
| 5,896,724 | A | | 4/1999 | Tofts | |
| 6,108,994 | A | * | 8/2000 | Bodine | 52/506.07 |
| 6,205,733 | B1 | * | 3/2001 | LaLonde | 52/506.07 |
| 6,230,463 | B1 | | 5/2001 | Bodine | |
| 6,260,325 | B1 | * | 7/2001 | Wendt et al. | 52/506.07 |
| 6,374,564 | B1 | | 4/2002 | Fletterick et al. | |
| 6,389,771 | B1 | * | 5/2002 | Moller | 52/506.06 |
| 6,523,314 | B1 | * | 2/2003 | LaLonde et al. | 52/506.07 |
| 6,536,173 | B2 | * | 3/2003 | Rebman | 52/465 |
| 7,062,886 | B2 | * | 6/2006 | Auriemma | 52/506.07 |
| 2003/0213199 | A1 | * | 11/2003 | Bongio et al. | 52/506.01 |

FOREIGN PATENT DOCUMENTS

| | | | | |
|---|---|---|---|---|
| EP | 1154089 | A1 | | 11/2001 |
| GB | 2182079 | A | * | 5/1987 |

* cited by examiner

DOWNWARDLY ACCESSIBLE LIFT-AND-SHIFT CEILING SYSTEM

BACKGROUND OF THE INVENTION

The invention relates to suspended ceiling grid tee and tile structure of a type, useful in applications where overhead clearance is limited, that can be removed downwardly.

PRIOR ART

Suspended ceilings typically comprise a metal grid of intersecting runners, usually in the form of inverted tees, and rectangular tiles supported on the grid runners or tees.

Downwardly accessible lift-and-shift tiles have been developed. Examples of such prior art are shown in U.S. Pat. Nos. 6,108,994 and 6,389,771, for example. Downward accessibility offers the recognized benefits of a suspended ceiling with removable and/or replaceable tiles and, additionally, the ability to be used where overhead clearance is limited. Among other benefits, this low clearance feature can be used in the original design of a building to save height at each floor level. In a high rise building, this height reduction can amount to a considerable savings of material and, therefore, overall construction costs even when only a few inches per floor level are involved. Additionally, by their nature, downwardly accessible tiles can be made to conceal parts of the faces of the grid tees to thereby obtain a different and, often, a richer or more refined appearance.

Prior art downwardly accessible ceilings have relied on tiles with multi-stepped kerfs or rabbeted edges to achieve their requisite functionality of being both self-centering and slightly liftable for shifting to provide access. These stepped edges can be difficult to manufacture with the required dimensional tolerances and can be susceptible to damage during shipment, handling, and installation. Accordingly, there remains a need for a downwardly accessible ceiling system that can be manufactured more easily and is more robust when being transported or otherwise handled.

SUMMARY OF THE INVENTION

The invention provides a downwardly accessible lift-and-shift suspended ceiling system that simplifies tile construction and thereby reduces manufacturing costs and difficulties as well as potential damage from mishandling. The invention achieves these benefits by assigning part of the tile centering function, in a unique manner, to specialized centering elements on the grid tees.

More specifically, in accordance with the invention, the grid tees are provided with locating surfaces on the top or backside of their flanges spaced laterally a predetermined distance from the plane of a central web and a predetermined distance from the distal edge of their respective flange portions. The locating surfaces are positioned in relation to the upper edge surfaces of the tiles associated with the kerfs or grooves to properly center a tile in the grid space.

The locating surfaces can be formed integrally with the grid tees or can be provided on separately formed bracket or clip attached to the tees when the grid tees are manufactured or in the field when the grid is originally installed or as a retrofit to an existing grid installation.

With the locating surfaces serving to horizontally position the tiles in the grid, the rabbets need less complexity in their shapes and are, therefore, easier to cut and involve less dimensional control. Besides being less susceptible to damage when being handled, ceiling tiles constructed in accordance with the invention with a proper kerf or edge design that do sustain physical damage that might detract from their ability to be properly centered when installed on a grid are readily seen and, therefore, can be corrected, or can be rejected by the installer before being installed.

DESCRIPTION OF THE PREFERRED EMBODIMENTS

Figure 1:
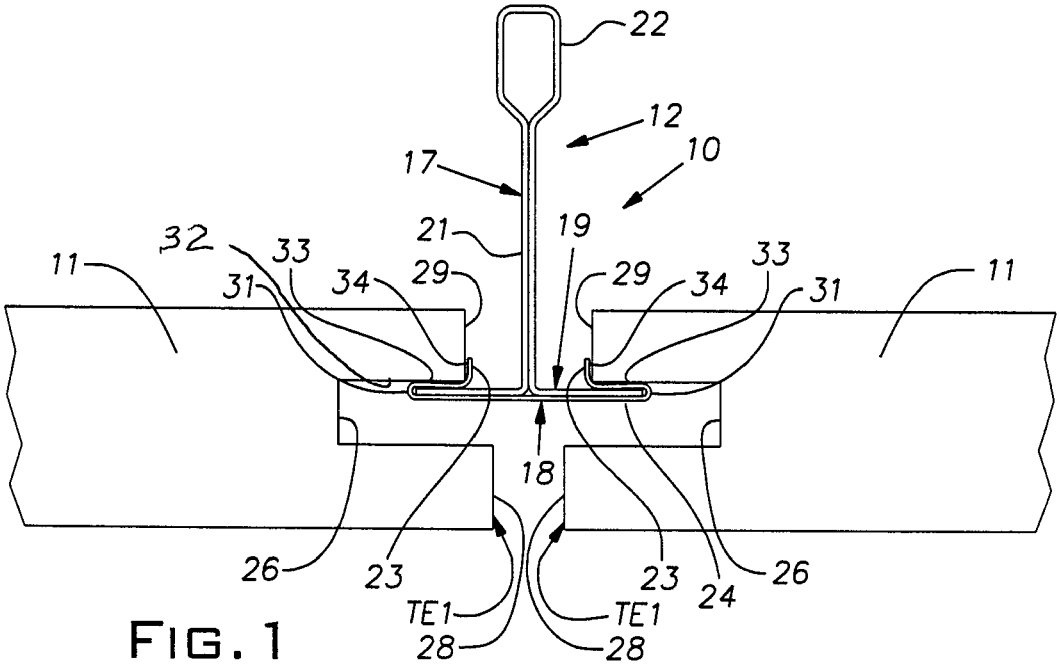
FIG. 1 is a fragmentary edge view of a pair of ceiling tiles and a grid tee constructed in accordance with the invention.
Figure 2:
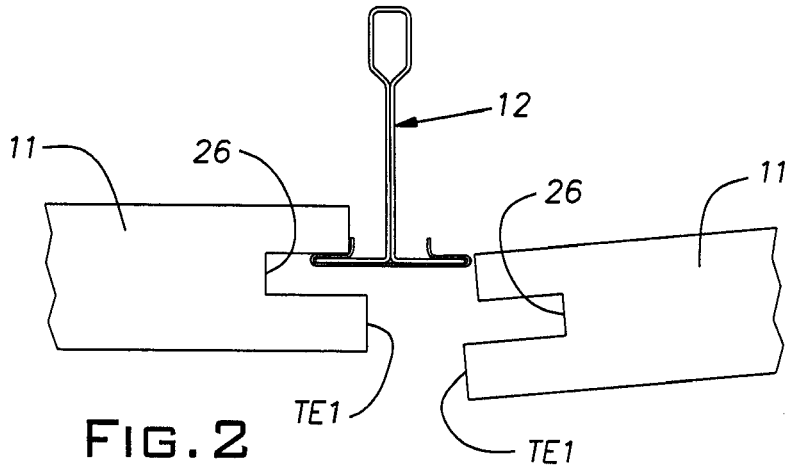
FIG. 2 is a view similar to FIG. 1 showing an intermediate step of mounting or demounting a tile.
Figure 3:
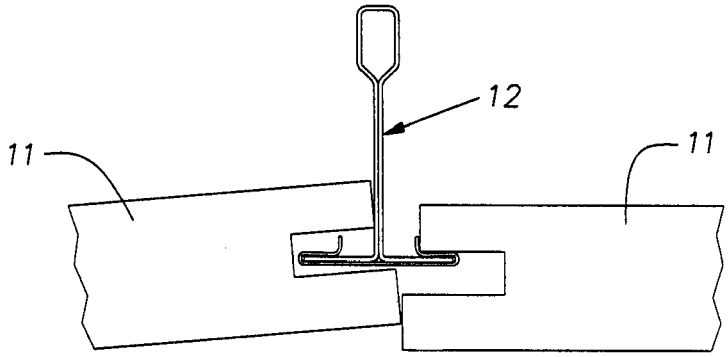
FIG. 3 is a view similar to FIGS. 1 and 2 showing the opposite end of the tile shown in FIG. 2, in the intermediate step.
Figure 8:
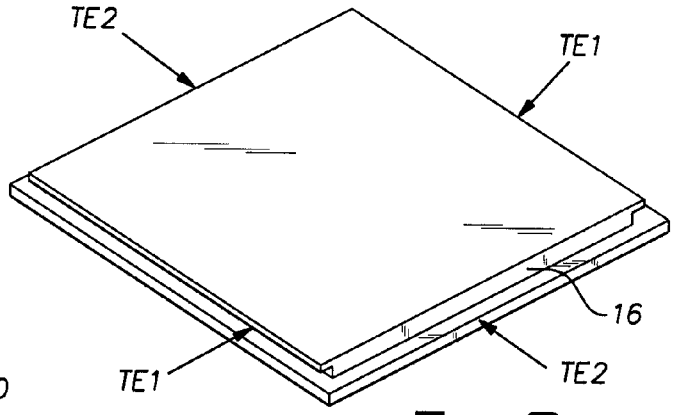
FIG. 8 is a perspective view of an example of a ceiling tile for use in practicing the invention.

Referring now to the figures, a suspended ceiling system 10 comprises ceiling tiles 11 carried on grid tees 12. A pair of ceiling tiles 11, partially shown in FIGS. 1-3, and fully in FIG. 8, are mounted on grid tees, one of which is shown in FIGS. 1-3. The tiles 11 are of any rigid relatively low density composition, known in the art, and typically have acoustic and fire-resistant properties. The tiles 11, as shown in FIG. 8, are generally planar and rectangular in plan view, being typically nominally 2 foot by 2 foot (or metric equivalent) square or rectangular with 2 foot by 4 foot (or metric equivalent) nominal dimensions. The tiles 11 have edge details that are the same at opposite parallel edges but, with respect to a specific edge, is different at adjacent perpendicular edges. Tile edges TE1 correspond to rabbeted grooved edges shown in FIGS. 1-3, and tile edges TE2 are simply rabbeted, preferably with a square cut, and can be devoid of any groove or undercut. Vertical edge surfaces 16 on the non-grooved edges TE2 are arranged to center the respective tile 11 between grid tees 12 that are adjacent to them when installed on a grid by contacting the edges of the flanges of these tees.

The grid tee 12 of FIGS. 1-3, which can be a main tee and/or a cross tee is preferably roll-formed of sheet metal strips. The tee 12 has a main body 17 and a cap 18. The strip of the main body 17 is fashioned to include a horizontal lower flange 19, a vertical web 21 and an upper hollow reinforcing bulb 22. The cap or strip 18 covers the lower side of the main body flange 19 and wraps over marginal edge portions of the upper side of the flange. Marginal edge areas of the cap or strip 18 are turned up to form a short vertical flange 23, at each side of the tee 12, running continuously along the length of the tee and spaced a predetermined distance laterally in from the distal edge of the flange 19 and outwardly from the web 21. The height of the vertical flange 23, measured from a lower visible face 24 of the cap 18 is less than the width, measured vertically, of a groove 26 in each of the grooved, rabbeted tile edges TE1.

The tile 11 illustrated in FIGS. 1-3 and 8 has its lower vertical edge surface 28 laterally outward of an upper vertical edge surface 29. The depth of the groove 26, measured horizontally from the upper edge surface 29, is preferably at least as large as the distance from a distal edge 31 of the capped flange 19 to an adjacent face of the web 21.

As shown in FIG. 1, the vertical position or elevation of the tile 11 in the grid is established by a downwardly facing side 32 of the groove 26 resting on an upwardly facing side of a return or hem area 33 of the cap 18. When the tile 11 is installed, the upper vertical surfaces 29 of the tile edges TE1 abut or are spaced a small predetermined dimensional tolerance from an outer locating surface 34 of the cap vertical flange 23 thereby causing the tile to be centered in the respective grid space in the respective horizontal direction between the opposed grooved edges TE1.

The tilted tile 11 depicted at the left in FIG. 3 can be understood to be the same tile as the tilted tile on the right in FIG. 2. Thus, the grid tee 12 shown in FIG. 3 is parallel to the tee 12 in FIG. 2 and is spaced therefrom by the selected grid module, typically 2 foot or metric equivalent. FIGS. 2 and 3 show an instantaneous intermediate position or step in the mounting or dismounting of a tile 11 on the grid tees 12. By lifting the edge TE1 of the tile 11, as shown in FIG. 3, the tile can be shifted horizontally until the upper vertical edge face 29 abuts the adjacent tee web 21. This horizontal shifting permits the left edge TE1 of the tile 11, as shown in FIG. 2, to be lowered off of the flange 19, including the cap 18, of its respective tee 11. Once the left edge TE1 of the tile 11 is further lowered somewhat from that shown in FIG. 2, it can be shifted horizontally to the left until the right side is clear of the respective flange 19 and cap 18. Then, the whole tile 11 can be completely removed. The steps for installation of a tile 11 are reversed from that discussed immediately above. It will be appreciated that when the tile 11 is lowered or raised in a tilting motion or in translation, the panel edges TE2 are unhindered in vertical movement by their adjacent grid tees.

Figure 4:
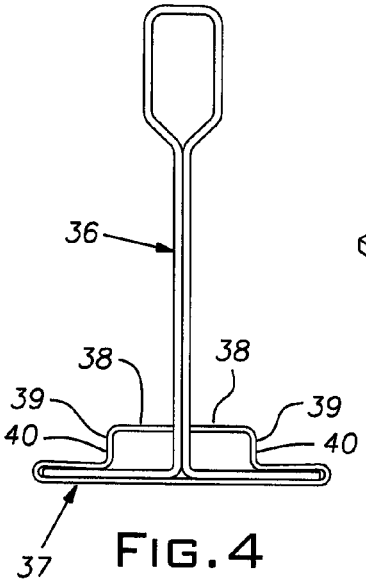
FIG. 4 is an end view of an alternative embodiment of a grid tee in accordance with the invention.

FIG. 4 depicts grid tees 36 with a modified form of cap 37 from that shown in FIGS. 1-3. The same numerals are used to designate the same or like parts of the tees 36. The cap 37 has horizontal flanges 38 extending from upper edges of vertical webs 39 and running continuously along the length of the tee 36. The grid tee 36 can be used with the tile 11 in essentially the same way as that described in connection with FIGS. 1 and 3.

More specifically, the tile 11 is centered with the grid tee 36 by restraint, within appropriate dimensional tolerances, between the upper vertical edge surface 29 and outwardly facing locating surfaces 40 of the vertical cap webs 39.

Figure 5:
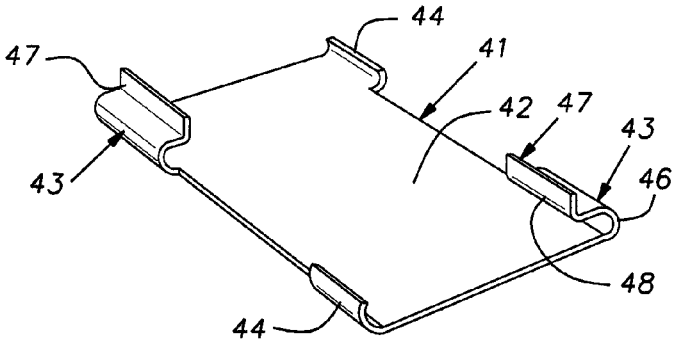
FIG. 5 is a perspective view of a first form of a clip usable with a conventional grid tee to practice the invention.

FIG. 5 shows a separate clip 41 that can be installed on a conventional grid tee 45, i.e. a tee without the vertical cap flanges 23 (FIGS. 1-3) or vertical webs 39 (FIG. 4). The clip 41, which can be stamped out of sheet metal or can be molded of a suitable rigid plastic, includes a generally planar rectangular main body 42 and a set of oppositely facing, diagonally disposed upstanding U-shaped grips 43 and oppositely facing diagonally disposed vertical stops 44. The clip or bracket 41 is installed on a grid tee 45, typically of a standard cross-sectional profile, by pressing a top surface of the body 42 towards the lower face of the tee flange while its longitudinal axis is at an angle to the longitudinal direction of the tee. The clip 41 is then rotated so that the upper parts of the U-shaped grips 43 slide over the tops of the tee flange and then the short legs or stops 44 snap up and against the adjacent edges of the flange to thereby fasten the clip to the tee. A plurality of clips 41 are positioned at regularly spaced locations along a grid tee 45 so that preferably at least two clips are situated to be engaged by one edge TE1 of a tile 11 to locate the tile properly. The U-shaped grips 43, spaced inwardly from their outward extremities represented by generally vertical bights 46, have generally upright legs 47 that provide vertical tile locating surfaces 48. These uprights or legs 47 have their locating surfaces 48 in positions like the vertical locating surfaces 34 and 40 of the tees 12 and 36, respectively, so that they perform the same tile locating functions as these latter surfaces.

Figure 6:
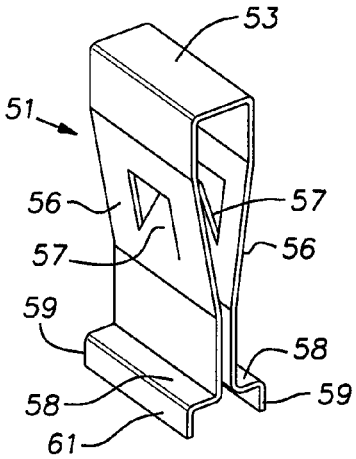
FIG. 6 is a perspective view of a second form of a clip usable on a standard grid tee to practice the invention.

FIG. 6 illustrates another version of a clip 51 that can be used with a grid tee 45 of a standard conventional inverted tee configuration. Overall, the clip 51 has an inverted U-shape when viewed on edge as in FIG. 7 where the clip is shown installed on a grid tee 45 of conventional geometry. The clip or bracket 51 can be stamped out of steel sheet or can be molded of a suitable rigid plastic. At an upper end, the clip 51 has a bight or bridge section 53 proportioned to fit over the reinforcing bulb 54 of the tee 45. Depending legs 56 extending from the bight 53 converge towards an imaginary central plane of the clip 51. Lanced out of or projecting from the mid-section of the legs 56 are tabs 57 bent inwardly towards the imaginary mid-plane of the clip 51. Free ends of the tabs 57 are spaced sufficiently below the upper bight 53 so that they can snap under the reinforcing bulb 54 and thereby retain the clip 51 in position on the tee 45.

At their lower ends, the opposed legs 56 each include a generally horizontal foot 58 and at the distal end of each foot is a depending generally vertical flange 59. The depending flange 59 provides a generally vertical locating surface 61 analogous to the surfaces 34, 40, and 48 of the earlier described arrangements and, as indicated in FIG. 7, provide the same tile locating or centering function as these previously disclosed surfaces.

Figure 7:
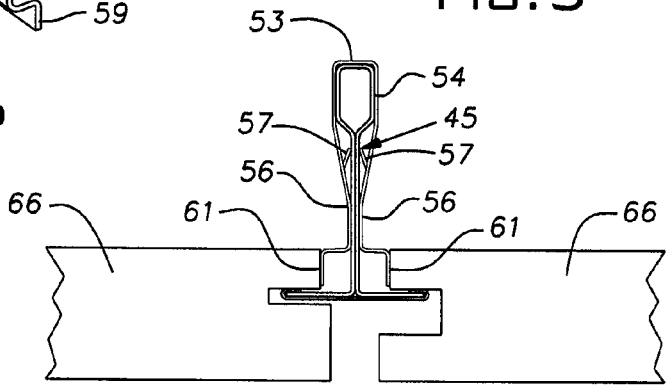
FIG. 7 is a fragmentary edge view of a pair of tiles and the clip of FIG. 6 installed on a conventional grid tee.

FIG. 7 illustrates a variation of the construction of a ceiling tile 66. In this construction, the tile 66 is asymmetric when viewed from a vantage point corresponding to FIGS. 1-3. In FIG. 7, a panel 66 on the right side of the tee 45 has a grooved rabbeted edge corresponding to the edges of the tile 11 in FIGS. 1-3. By contrast, an opposite edge of the tile 66, shown at the left side of the tee 45 in FIG. 7, has a rabbeted grooved edge wherein the groove is relatively narrow in a vertical direction with only adequate clearance to allow the tile 66 to be tilted when the opposite side is lifted and shifted as in FIG. 3.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A suspended ceiling system comprising grid runners and downwardly accessible generally planar tiles mounted on the grid runners, the tiles being rectangular in plan view with four peripheral edges, the peripheral edges each having portions that extend horizontally underneath an adjacent grid runner, each edge of an oppositely disposed pair of said edges having a groove with a downwardly facing support surface and an associated one of the underneath extending portions disposed between a plane of a lower visible face of the tile and a plane of an upper back face of the tile, the grid runners each being symmetrical about a vertical mid-plane and having horizontal flange portions extending in opposite directions away from said mid-plane, each of said oppositely disposed edges of said tiles having a generally vertical abutment surface above its support surface, the support surface resting on the adjacent horizontal flange portion, the runners having locating surfaces of limited height rising above said flange portions and engageable with the abutment surfaces, the abutment surfaces being free of portions of the tile that lie above the abutment surfaces in an installed orientation of the tile, the grooves having a height at least equal to the combined height of the flange and a locating surface so that the flange and locating surface can be received in a groove when one of the opposed tile edges is lifted and its abutment surface is raised above an adjacent locating surface and the tile can thereafter be shifted towards the runner adjacent the lifted edge a distance sufficient to allow the opposite edge to drop below the flange portion of its associated runner.

2. A suspended ceiling system as set forth in claim 1, wherein said grid runners have an end profile of an inverted "T".

3. A suspended ceiling system as set forth in claim 1, wherein said tiles have a pair of opposed edges perpendicular to said oppositely disposed edges, said opposed edges being rabbeted in a manner that is devoid of undercut slots.

4. A suspended ceiling system as set forth in claim 1, wherein said grid runners provide said locating surfaces continuously along their lengths.

5. A suspended ceiling system as set forth in claim 1, wherein said locating surfaces are formed by clips separately formed from said grid runners and located on said grid runners at locations spaced longitudinally on said grid runners.

6. A suspended ceiling system as set forth in claim 5, wherein said clips are attached to said grid runners from a direction above said flange portions.

7. A suspended ceiling system as set forth in claim 5, wherein said clips are attached to said grid runners from a direction below said flange portions.

8. A suspended ceiling system as set forth in claim 5, wherein said clips are retained on said grid runners by snap action.

9. A suspended ceiling system as set forth in claim 1, wherein said locating surfaces are formed integrally with said grid runners.

* * * * *